US007631394B2

(12) United States Patent
Oh et al.

(10) Patent No.: US 7,631,394 B2
(45) Date of Patent: Dec. 15, 2009

(54) SUCTION BRUSH FOR VACUUM CLEANER

(75) Inventors: Jang-keun Oh, Gwangju (KR); Min-ha Kim, Gwangju (KR); Dong-houn Yang, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 156 days.

(21) Appl. No.: 12/070,756

(22) Filed: Feb. 21, 2008

(65) Prior Publication Data

US 2009/0049642 A1 Feb. 26, 2009

(30) Foreign Application Priority Data

Aug. 21, 2007 (KR) ..... 10-2007-0084096

(51) Int. Cl.
*A47L 5/34* (2006.01)
*A47L 9/28* (2006.01)

(52) U.S. Cl. ..... 15/354; 15/358

(58) Field of Classification Search ..... 15/354–358; *A47L 5/34, 9/28*
See application file for complete search history.

(56) References Cited

U.S. PATENT DOCUMENTS 4,706,327 A * 11/1987 Getz et al. ..... 15/319
7,203,993 B2 * 4/2007 Tondra et al. ..... 15/362
7,316,051 B2 * 1/2008 Budd ..... 15/361
2006/0130270 A1 * 6/2006 Tondra et al. ..... 15/354

FOREIGN PATENT DOCUMENTS

JP 2005177459 * 7/2005
KR 1020040086643 10/2004
KR 1020050063548 6/2005

* cited by examiner

*Primary Examiner*—David A Redding
(74) *Attorney, Agent, or Firm*—Ohlandt, Greeley, Ruggiero & Perle, L.L.P.

(57) ABSTRACT

A suction brush for a vacuum cleaner is provided. The suction brush includes an upper casing; a lower casing; an elevating plate installed between the upper casing and the lower casing; a cleaned surface sensing part for sensing; a lever rotatably provided around a rotating shaft that is parallel to the elevating plate; and a solenoid. The solenoid rotates the lever in one direction when the surface to be cleaned is the hard floor and rotates the lever in the other direction when the surface to be cleaned is the carpet. The lower casing contacts the surface to be cleaned as the elevating plate descends, while it comes apart from the surface to be cleaned as the elevating plate ascends.

6 Claims, 4 Drawing Sheets

SUCTION BRUSH FOR VACUUM CLEANER

CROSS-REFERENCE TO RELATED APPLICATIONS

This application claims the benefit under 35 U.S.C. §119 of Korean Patent Application No. 2007-84096, filed Aug. 21, 2007, in the Korean Intellectual Property Office, the entire disclosure of which is incorporated herein by reference.

BACKGROUND OF THE INVENTION

1. Field of the Invention

The present disclosure relates generally to a suction brush for a vacuum cleaner. More particularly, the present disclosure relates to a suction brush for a vacuum cleaner that is capable of automatically adjusting a distance between a lower casing having a suction inlet formed thereon and a surface to be cleaned depending on whether the surface to be cleaned is a hard floor or a carpet.

2. Description of the Related Art

Generally, a vacuum cleaner is an electric device that draws in dust and other foreign materials existing on a surface to be cleaned using a suction force generated by a vacuum source. Diverse kinds of vacuum cleaners have been developed and used. A canister type vacuum cleaner, which is one of such vacuum cleaners, is typically composed of a main body, a connection part, and a suction brush.

In the main body, a vacuum source, such as a suction motor that generates a suction force, and a dust collection part for collecting the drawn-in dust and foreign materials are installed. The connection part is provided with a handle for user's handling, an extension tube for connecting the handle with a suction brush, and a flexible hose for connecting the handle with the main body. The suction brush is a part that is in contact with the surface to be cleaned and draws in the dust and foreign materials, and has a suction port formed on a bottom surface of the suction brush to draw in the dust and foreign materials.

Representative surfaces to be cleaned by the vacuum cleaner may be a hard floor and a carpet. Here, the hard floor is a general name of smooth surfaces to be cleaned, which are made of stone, lumber, or laminated paper.

In the case where the surface to be cleaned is a hard floor, the suction brush for a vacuum cleaner is apt to stick to the surface to be cleaned, and the manipulation resistance of the suction brush becomes great, so that it is laborious for a user to manipulate the suction brush. By contrast, in the case where the surface to be cleaned is a carpet, the suction brush rarely sticks to the surface to be cleaned. However, in order to draw in dust and other foreign materials existing between wool or fibers closely formed on an upper surface of the carpet, a relatively greater suction force is required in comparison to the hard floor.

The manipulation resistance and the suction force of the suction brush having a suction port formed thereon against the surface to be cleaned are closely connected with the distance between the bottom surface of the suction brush and the surface to be cleaned. That is, as the distance between the bottom surface of the suction brush and the surface to be cleaned is smaller, the manipulation resistance and the suction force become larger, while as the distance between the bottom surface of the suction brush and the surface to be cleaned is larger, the manipulation resistance and the suction force become smaller.

However, on the assumption that the distance between the bottom surface of the suction brush and the surface to be cleaned is kept constant, the hard floor has a large manipulation resistance to cause the user to be laborious, while in the case of the carpet, the suction force becomes weak, and thus the dust and other foreign materials existing between wool of the carpet cannot be effectively drawn-in.

In order to solve this problem, a conventional suction brush for a vacuum cleaner has been developed, which can properly vary the distance between a bottom surface of the suction brush and a surface to be cleaned depending on the type of surface to be cleaned. On an upper surface of such a suction brush, a lever manually operated by a user is formed to be exposed. Accordingly, in the case where the surface to be cleaned is a hard floor, the user can reduce a manipulation resistance of the suction brush by relatively widening the distance between the bottom surface of the suction brush and the surface to be cleaned through the manipulation of the lever. Also, in the case where the surface to be cleaned is a carpet, the user can increase the suction rate of the suction brush by relatively narrowing the distance between the bottom surface of the suction brush and the surface to be cleaned.

However, the user's varying of the distance between the bottom surface of the suction brush and the surface to be cleaned through the user's manual operation of the lever should be done whenever the surface to be cleaned is changed, and this causes the user inconvenience.

SUMMARY OF THE INVENTION

Embodiments of the present disclosure have been developed in order to substantially solve the above and other problems associated with the conventional arrangement and provide the objectives listed below. An aspect of embodiments of the present disclosure is to provide a suction brush for a vacuum cleaner that can automatically adjust the distance between a bottom surface of the suction brush having a suction inlet formed thereon and a surface to be cleaned when the surface to be cleaned is changed from a hard floor to a carpet and vice versa.

The foregoing and other objects and advantages are substantially realized by providing a suction brush for a vacuum cleaner, according to embodiments of the present disclosure, which comprises an upper casing; a lower casing fixedly coupled to the upper casing and having a suction port, formed thereon, for drawing in dust and other foreign materials existing on a surface to be cleaned; an elevating plate installed between the upper casing and the lower casing so as to ascend from and descend against the lower casing and having a lever insertion part formed thereon; a cleaned surface sensing part for sensing whether the surface to be cleaned is a hard floor or a carpet; a lever rotatably provided around a rotating shaft that is parallel to the elevating plate, one end of the lever being inserted into the lever insertion part and pressing the elevating plate downward when the lever is rotated in one direction, while one end of the lever seceding from the lever insertion part when the lever is rotated in the other direction; and a solenoid for rotating the lever in one direction when it is sensed that the surface to be cleaned is the hard floor and rotating the lever in the other direction when it is sensed that the surface to be cleaned is the carpet; wherein the lower casing becomes in contact with the surface to be cleaned as the elevating plate is descending, while it comes apart from the surface to be cleaned as the elevating plate is ascending.

The lever may comprise a center part through which the rotating shaft passes; a connection part formed to extend from one side of the center part and connected to the solenoid; and an elevating plate pressing part formed to extend from the other side of the center part and detachably inserted into the lever insertion part.

The solenoid may comprise a solenoid main body; a plunger driven in a straight line by the solenoid main body; and a connection pin coupled to one end of the plunger in a direction perpendicular to the plunger and connecting the plunger to the connection part of the lever; wherein a guide groove through which the connection pin passes and which guides sliding of the connection pin is formed in the connection part of the lever.

The elevating plate pressing part may further comprise a support shaft one end of which is inserted into the center part of the lever, the support shaft supporting the lever as it rotates together with the lever.

The cleaned surface sensing part may comprise a fixed plate horizontally kept at a specified height from a bottom of the surface to be cleaned; a micro switch arranged on an upper part of the fixed plate; and a rotating member installed on the fixed plate to have a rotating shaft that is parallel to the fixed plate and having a cleaned surface contact part, provided on one end thereof, for being in contact with the surface to be cleaned and a switch contact part, provided on the other end thereof, for being in contact with a contact terminal of the micro switch.

The suction brush according to embodiments of the present disclosure may further comprise a power supply part for supplying a power to the solenoid.

The suction brush for a vacuum cleaner as constructed above according to embodiments of the present disclosure can automatically adjust the distance between the lower casing having a suction inlet formed thereon and the surface to be cleaned depending on whether the surface to be cleaned is a hard floor or a carpet.

BRIEF DESCRIPTION OF THE DRAWINGS

The above aspects and features of embodiments of the present disclosure will become more apparent by describing certain exemplary embodiments of the present disclosure with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
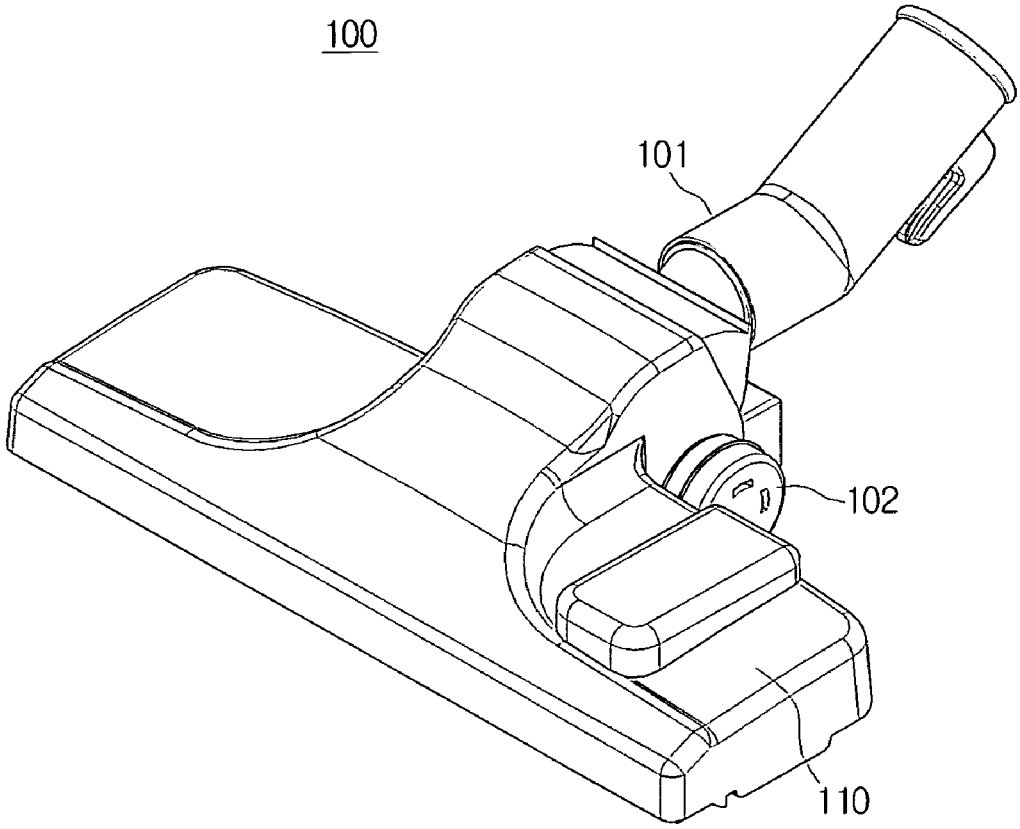
FIG. 1 is a perspective view of a suction brush for a vacuum cleaner according to an embodiment of the present disclosure.

Certain exemplary embodiments of the present disclosure will now be described in greater detail with reference to the accompanying drawings.

In the following description, same drawing reference numerals are used for the same elements even in different drawings. The matters defined in the description, such as detailed construction and elements, are provided to assist in a comprehensive understanding of the disclosure. Thus, it is apparent that the present disclosure can be carried out without those specifically defined matters. Also, well-known functions or constructions are not described in detail since they would obscure the disclosure with unnecessary detail.

Hereinafter, a suction brush for a vacuum cleaner according to an embodiment of the present disclosure will be described in detail with reference to FIGS. 1 to 6.

Figure 2:
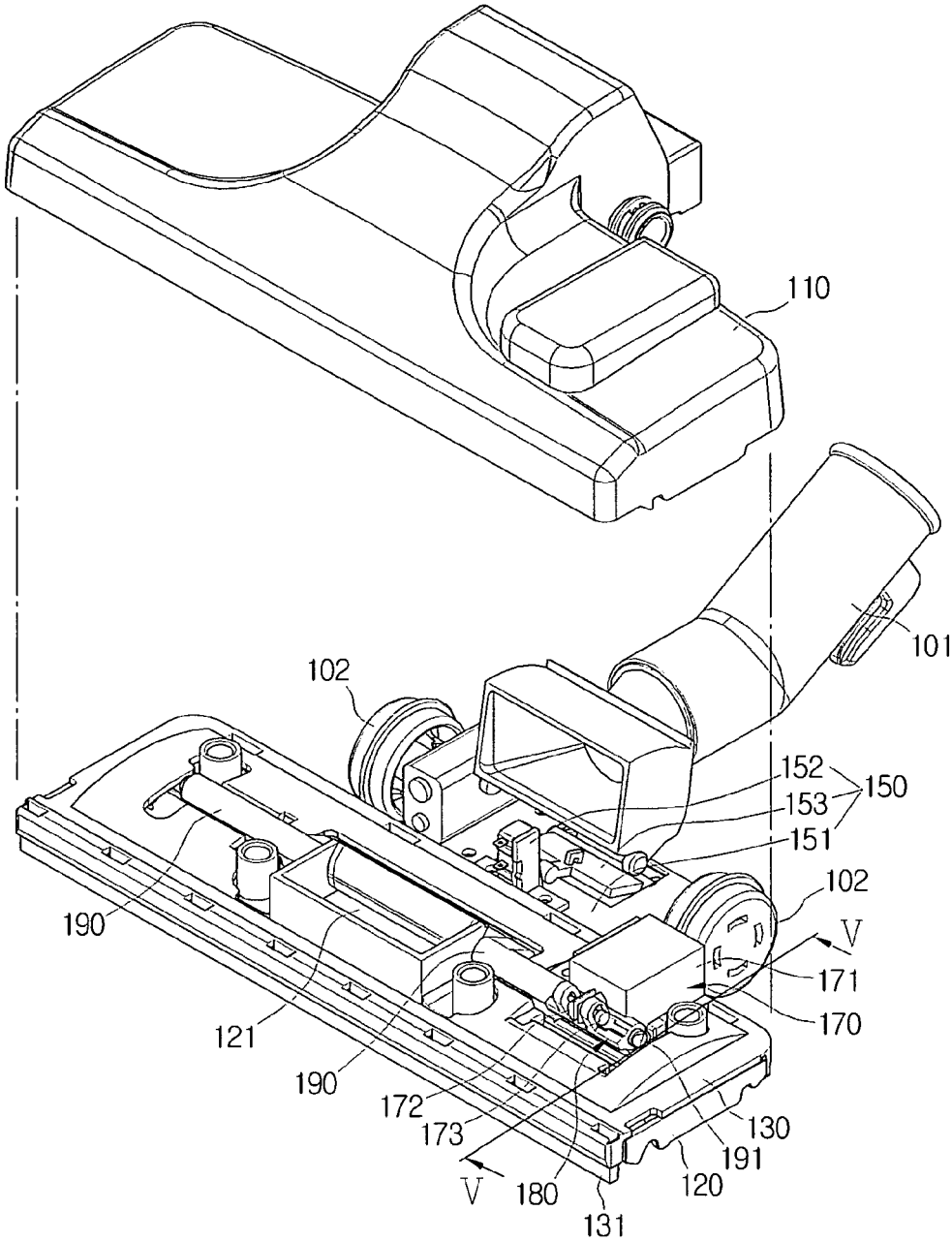
FIG. 2 is a perspective view of the suction brush of FIG. 1 from which an upper casing is disassembled.
Figure 3:
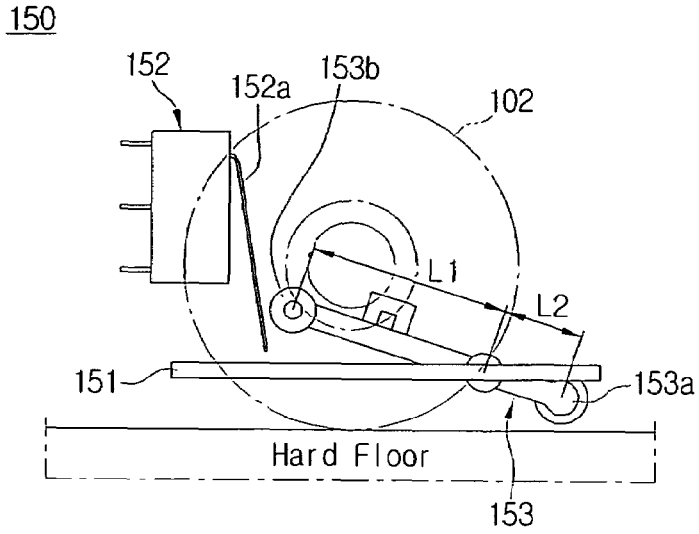
FIG. 3 is a side view of the suction brush of FIG. 1 in a state that a cleaned surface sensing unit provided in the suction brush is placed on a hard floor.
Figure 4:
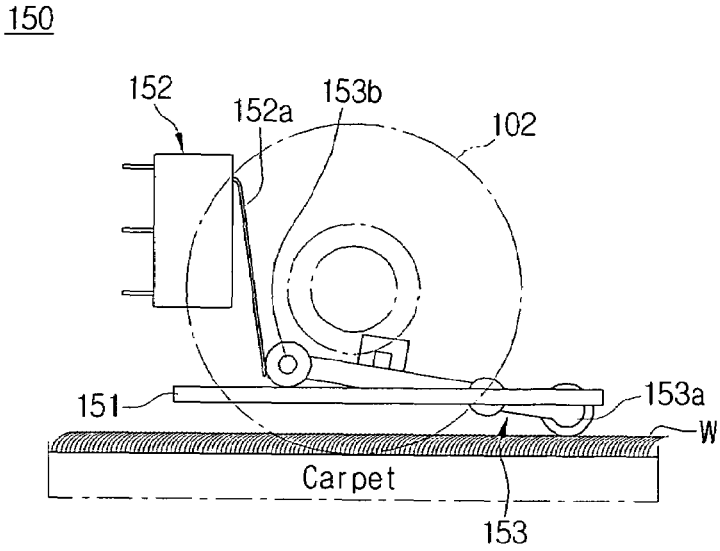
FIG. 4 is a side view of the suction brush of FIG. 1 in a state that a cleaned surface sensing unit provided in the suction brush is placed on a carpet.
Figure 5:
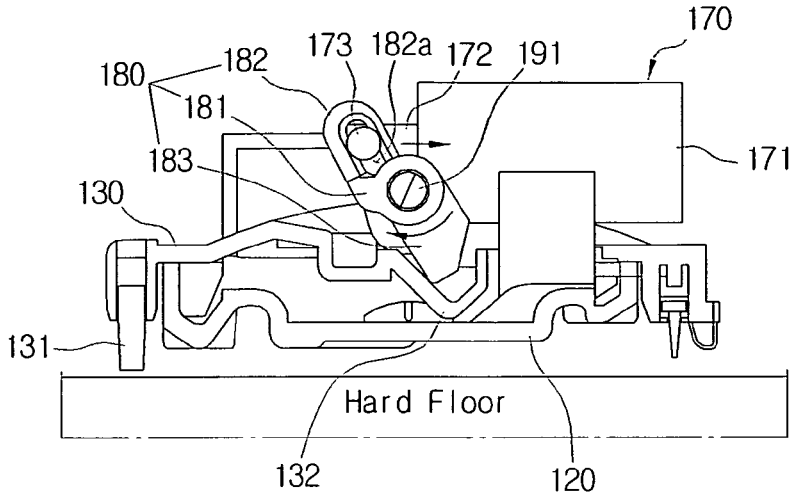
FIG. 5 is a cut-away perspective view taken along V-V line of FIG. 2 in the event that the surface to be cleaned is a hard floor.
Figure 6:
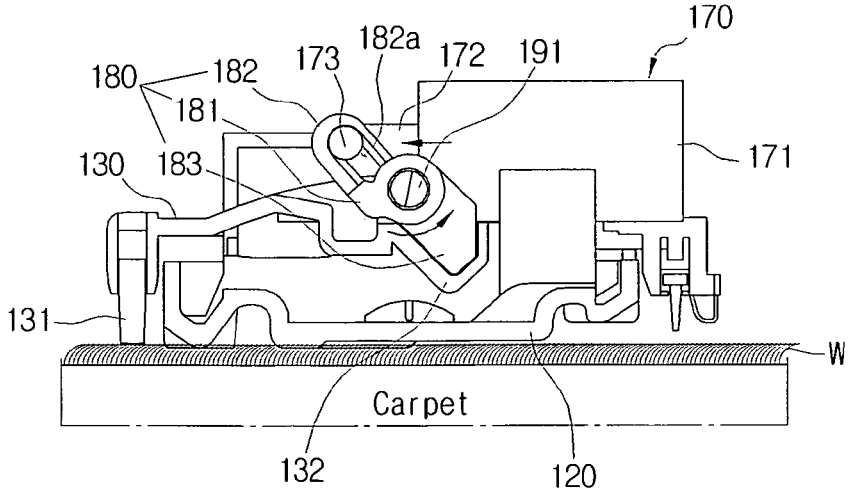
FIG. 6 is a cut-away perspective view taken along V-V line of FIG. 2 in the event that the surface to be cleaned is a carpet.

FIG. 1 is a perspective view of a suction brush for a vacuum cleaner according to an embodiment of the present disclosure, and FIG. 2 is a perspective view of the suction brush of FIG. 1 from which an upper casing is disassembled. FIG. 3 is a side view of the suction brush of FIG. 1 in a state that a cleaned surface sensing unit provided in the suction brush is placed on a hard floor, and FIG. 4 is a side view of the suction brush of FIG. 1 in a state that a cleaned surface sensing unit provided in the suction brush is placed on a carpet. FIG. 5 is a cut-away perspective view taken along V-V line of FIG. 2 in the event that the surface to be cleaned is a hard floor, and FIG. 6 is a cut-away perspective view taken along V-V line of FIG. 2 in the event that the surface to be cleaned is a carpet.

Referring to FIGS. 1 to 6, the suction brush 100 for a vacuum cleaner according to an embodiment of the present disclosure comprises an upper casing 110, a lower casing 120, an elevating plate 130, a cleaned surface sensing part 150, and an elevating plate pressing part.

The upper casing 110 and the lower casing 120 are fixedly coupled to each other. The lower casing 120 is arranged to face a surface to be cleaned during cleaning of the surface to be cleaned. A suction port 121 for drawing in dust and other foreign materials existing on the surface to be cleaned is formed in a center region of the lower casing 120, and the dust drawn-in through the suction port 121 is guided to a connection tube connector 101 through a guide flow path (not illustrated) formed in the upper casing 110.

The elevating plate 130 is arranged between the upper casing 110 and the lower casing 120, and operates to ascend and descend against the lower casing 120. Referring to FIG. 2 or 5, a pair of ribs 131 is inserted into both end portions of the elevating plate 130 in a width direction of the elevating plate 130. When the elevating plate 130 ascends, the lower casing 120 relatively descends to be in close contact with the surface to be cleaned, while when the elevating plate 130 descends, the lower casing 120 relatively ascends to come apart from the surface to be cleaned.

Referring to FIG. 5, a lever insertion part 132 is formed downward from an upper surface of the elevating plate 130, and an elevating plate pressing part 183 of the lever 180 to be described later may be detachably inserted in the lever insertion part 132.

Referring to FIG. 2, the cleaned surface sensing unit 150 is installed in a region between a pair of suction brush wheels 102, and senses whether the surface to be cleaned is a hard floor or a carpet. Referring to FIGS. 3 and 4, the cleaned surface sensing part 150 comprises a fixed plate 151, a micro switch 152, and a rotating member 153.

The fixed plate 151 is horizontally kept at a specified height from the surface to be cleaned.

The micro switch 152 is arranged on an upper portion of the fixed plate 151, and at one end thereof, a contact terminal 152*a* is formed adjacent to the rotating member 153. This micro switch 152 is electrically connected to the solenoid 170 to be described later.

The rotating member 153 is installed on the fixed plate 151, and may be rotated around a rotating shaft that is parallel to the rotating member 153. At one end of the rotating member 153, a cleaned surface contact portion 153*a* that can be in contact with the surface to be cleaned is provided, and at the other end of the rotating member 153, a switch contact portion 153*b* that can keep in contact with a contact terminal 152*a* of the micro switch 152 is provided.

If the surface to be cleaned is a hard floor as illustrated in FIG. 3, the switch contact portion 153*b* of the rotating member 153 is not in contact with the contact terminal 152*a*, but is kept apart from the contact terminal 152*a*. For convenience' sake, the state of the micro switch 152 in the event that the switch contact portion 153*b* is apart from the contact terminal 152*a* of the micro switch 152 is indicated as an "open" state of the micro switch 152. Rotating member 153 is normally biased so that the switch contact portion 153*b* of the rotating member 153 is not in contact with the contact terminal 152*a*, but is kept apart from the contact terminal 152*a*.

By contrast, if the surface to be cleaned is changed to a carpet as illustrated in FIG. 4, the cleaned surface contact portion 153*a* of the rotating member 153 ascends as much as the height of wool W closely formed on the upper surface of the carpet. At this time, since the height of the fixed plate 151 on which the rotating member 153 is installed is kept constant, the rotating member 153 is rotated at a specified angle. At the same time, the switch contact portion 153*b* of the rotary member 153 descends to be in pressed contact with the contact terminal 152*a* of the micro switch 152. For convenience' sake, the state of the micro switch 152 in the event that the switch contact portion 153*b* is in pressed contact with the contact terminal 152*a* of the micro switch 152 is indicated as a "closed" state of the micro switch 152. Thus, the height of wool W closely formed on the upper surface of the carpet force overcomes the biasing force of rotating member 153 so that the switch contact portion 153*b* of the rotating member 153 is in contact with the contact terminal 152*a*.

It is preferable that the distance L1 from the rotating shaft of the rotating member 153 to the switch contact portion 153*b* is set to be greater than the distance from the rotating shaft of the rotating member 153 to the cleaned surface contact portion 153*a*. In the embodiment of the present disclosure, the distance L1 from the rotating shaft of the rotating member 153 to the switch contact portion 153*b* is 5 times the distance L2 from the rotating shaft of the rotating member 153 to the cleaned surface contact portion 153*a*. Accordingly, for example, if the cleaned surface contact portion 153*a* ascends for about 1 mm, the switch contact unit 153*b* descends to 5 mm. As a result, even in the case where the wool W formed on the carpet is relatively low, the cleaned surface sensing part 150 can clearly sense that the surface to be cleaned is the carpet.

If it is sensed that the surface to be cleaned is a hard floor, the elevating plate pressing part makes the elevating plate 130 descend, while if it is sensed that the surface to be cleaned is a carpet, the elevating plate pressing part makes the elevating plate 130 ascend.

Referring to FIGS. 2, 5, and 6, the elevating plate driving part comprises a solenoid 170 and a lever 180.

If it is sensed that the surface to be cleaned is the hard floor, the solenoid 170 rotates the lever 180 in one direction (e.g., clockwise in FIG. 5), while if it is sensed that the surface to be cleaned is the carpet, the solenoid 170 rotates the lever 180 in the other direction (e.g., counterclockwise in FIG. 6). The lever 180 is rotatably provided around the rotating shaft that is parallel to the elevating plate 130. If the lever 180 is rotated in one direction (e.g., clockwise in FIG. 5) by the solenoid 170, its lower end withdraws from the lever insertion unit 132, while if the lever is rotated in the other direction (e.g., counterclockwise in FIG. 6) by the solenoid 170, its lower end is inserted into the lever insertion unit 132 of the elevating plate 130.

Referring to FIGS. 5 and 6, the solenoid 170 comprises a solenoid main body 171, a plunger 172, and a connection pin 173.

In the solenoid main body 171, a coil (not illustrated) for generating a magnetic field is provided, and the plunger 172, one side of which is inserted into the solenoid main body 171, is driven in a straight line by the magnetic field generated by the coil. The coil in the solenoid main body 171 is electrically connected to the micro switch 152 of the cleaned surface sensing unit 150 as described above.

If the micro switch 152 is in an open state as illustrated in FIG. 3, i.e., if it is sensed that the surface to be cleaned is the hard floor, the coil generates the magnetic field so that the plunger 172 is retracted into the solenoid main body 171 as illustrated in FIG. 5. By contrast, if the micro switch 152 is in a closed state as illustrated in FIG. 4, i.e., if it is sensed that the surface to be cleaned is the carpet, the coil generates the magnetic field so that the plunger 172 is extended out of the solenoid main body 171.

The connection pin 173 is coupled to one end of the plunger 172 in a direction perpendicular to the plunger 172.

Referring to FIGS. 5 and 6, the lever 180 comprises a center part 181, a connection part 182, and an elevating plate pressing part 183. The rotating shaft of the lever 180 passes through the center part 181, the connection part 182 is formed to extend from one side of the center part 181, and the elevating plate pressing part 183 is formed to extend from the other side of the center part 181.

In the connection part 182, a guide groove 182*a*, through which the connection pin 173 provided at one end of the plunger 172 passes, is formed. The connection pin 173 is coupled to the connection part 182 so that it can slide along the guide groove 182*a* as the plunger 172 is driven in a straight line.

The elevating plate pressing part 183 has a shape that corresponds to the lever insertion part 132 formed on the elevating plate 130, and may be inserted into or withdrawn from the lever insertion part 132.

If the surface to be cleaned is the hard floor, the lever 180 is rotated clockwise by the solenoid 170 as illustrated in FIG. 5, and at this time, the elevating plate pressing unit 183 withdraws from the lever insertion part 132 to press the elevating plate 130 downward. As the elevating plate 130 is pressed downward, the lower casing 120 becomes relatively apart from the hard floor that is the surface to be cleaned.

If the surface to be cleaned is the carpet, the lever 180 is rotated counterclockwise by the solenoid 170 as illustrated in FIG. 6, and at this time, the elevating plate pressing unit 183 is inserted into the lever insertion part 132. As the elevating plate 183 is inserted into the lever insertion part 132, the pressing force being applied from the elevating plate pressing part 183 to the elevating plate 130 is released, and thus the lower casing 120 is kept in close contact with the carpet that is the surface to be cleaned.

Referring to FIGS. 2 and 5, the elevating plate pressing part also comprises a lever support shaft 190 installed parallel to the elevating plate 130. Referring to FIG. 5, one end 191 of the lever support shaft 190 is inserted into the center part 181 of the lever 180, and is also rotated when the lever 180 is rotated. Accordingly, the support shaft can stably support the lever 180 when the lever 180 is rotated by the solenoid 170.

Although not illustrated in the drawings, a power supply part such as a battery for supplying the power to the solenoid 170 may be installed in the suction brush 100.

The operation of the suction brush as constructed above according to an embodiment of the present disclosure will be described when the surface to be cleaned is changed from the hard floor to the carpet and vice versa during the cleaning.

Referring to FIGS. 3 and 6, the case where the surface to be cleaned is changed from the hard floor to the carpet will be described.

If a user contacts the suction brush 100 according to an embodiment of the present disclosure with the hard floor during the cleaning, the micro switch 152 of the cleaned surface sensing part 150 is kept in an open state as illustrated in FIG. 3. Then, as illustrated in FIG. 5, the plunger 172 of the solenoid 170 is drawn into the solenoid main body 171, and the elevating plate pressing part 183 presses the elevating plate 120 downward to keep the lever insertion part 183 of the elevating plate 130 in a seceding state. Accordingly, the elevating plate 130 is kept in a descending state, and the lower casing 120 is kept apart from the surface to be cleaned.

Thereafter, if the user moves the suction brush 100 to the carpet to clean the carpet, the micro switch 152 of the cleaned surface sensing part 150 is changed to a closed state as illustrated in FIG. 4. Accordingly, the direction of the magnetic field provided by the solenoid main body 171 is reversed, and thus the plunger 172 is straightly driven out of the solenoid main body 171. In this case, the lever 180 is rotated counter-clockwise (See FIG. 6), and the elevating plate pressing part 183 of the lever 180 is inserted into the lever insertion part 132 of the elevating plate 130. At this time, the pressing force being applied from the elevating plate pressing part 183 to the elevating plate 130 is released, and thus the elevating plate 130 is moved upward while the lower casing 120 is moved downward to become in close contact with the surface to be cleaned.

Then, referring to FIGS. 3 and 6, the case where the surface to be cleaned is changed from the carpet to the hard floor will be described.

If the user contacts the suction brush 100 according to an embodiment of the present disclosure with the carpet during the cleaning, the micro switch 152 of the cleaned surface sensing part 150 is kept in a closed state as illustrated in FIG. 4. Then, as illustrated in FIG. 6, the plunger 172 of the solenoid 170 is driven out of the solenoid main body 171, and the elevating plate pressing part 183 is inserted into the lever insertion part of the elevating plate 130. Accordingly, the elevating plate 130 is kept in an ascending state, and the lower casing 120 is kept in close contact with the surface to be cleaned.

Thereafter, if the user moves the suction brush 100 to the hard floor to clean the hard floor, the micro switch 152 of the cleaned surface sensing part 150 is changed to an open state as illustrated in FIG. 3. Accordingly, the direction of the magnetic field provided by the solenoid main body 171 is reversed, and thus the plunger 172 is drawn into the solenoid main body 171. In this case, the lever 180 is rotated clockwise (See FIG. 5), and the elevating plate pressing part 183 of the lever 180 secedes from the lever insertion part 132 of the elevating plate 130 to press the elevating plate 130 downward. Thus, the elevating plate 130 is moved downward while the lower casing 120 is moved upward to keep apart from the hard floor that is the surface to be cleaned.

As described above, according to the suction brush 110 according to embodiments of the present disclosure, the lower casing 120 is kept apart from the surface to be cleaned in the case where the surface to be cleaned is the hard floor. Accordingly, the manipulation resistance on the hard floor can be reduced, and thus the sticking of the lower casing 120 to the hard floor can be reduced.

By contrast, the lower casing 120 is kept in close contact with the surface to be cleaned in the case where the surface to be cleaned is the carpet. Accordingly, the dust and other foreign materials existing between wool of the carpet (See FIG. 6) can be effectively drawn-in, and thus the suction rate on the carpet can be improved.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A suction brush for a vacuum cleaner, comprising:

an upper casing;

a lower casing fixedly coupled to the upper casing and having a suction port, formed thereon, for drawing in dust and other foreign materials existing on a surface to be cleaned;

an elevating plate installed between the upper casing and the lower casing so as to ascend and descend against the lower casing and having a lever insertion part formed thereon;

a cleaned surface sensing part for sensing whether the surface to be cleaned is a hard floor or a carpet;

a lever rotatably provided around a rotating shaft that is parallel to the elevating plate, one end of the lever being inserted into the lever insertion part and pressing the elevating plate downward when the lever is rotated in one direction, while one end of the lever seceding from the lever insertion part when the lever is rotated in the other direction; and a solenoid for rotating the lever in one direction when it is sensed that the surface to be cleaned is the hard floor and rotating the lever in the other direction when it is sensed that the surface to be cleaned is the carpet;

wherein the lower casing becomes in contact with the surface to be cleaned as the elevating plate is descending, while it comes apart from the surface to be cleaned as the elevating plate is ascending.

2. The suction brush of claim 1, wherein the lever comprises:

a center part through which the rotating shaft passes;

a connection part formed to extend from one side of the center part and connected to the solenoid; and an elevating plate pressing part formed to extend from the other side of the center part and detachably inserted into the lever insertion part.

3. The suction brush of claim 2, wherein the solenoid comprises:

a solenoid main body;

a plunger driven in a straight line by the solenoid main body; and a connection pin coupled to one end of the plunger in a direction perpendicular to the plunger and connecting the plunger to the connection part of the lever;

wherein the connection part of the lever comprises a guide groove through which the connection pin passes and which guides sliding of the connection pin.

4. The suction brush of claim 2, wherein the elevating plate pressing part further comprises a support shaft having one end inserted into the center part of the lever, the support shaft supporting the lever as it rotates together with the lever.

5. The suction brush of claim 1, wherein the cleaned surface sensing part comprises:

a fixed plate horizontally kept at a specified height from a bottom of the surface to be cleaned;

a micro switch arranged on an upper part of the fixed plate; and a rotating member installed on the fixed plate to have a rotating shaft that is parallel to the fixed plate and having a cleaned surface contact part, provided on one end thereof, for being in contact with the surface to be cleaned and a switch contact part, provided on the other end thereof, for being in contact with a contact terminal of the micro switch.

6. The suction brush of claim 1, further comprising a power supply part for supplying a power to the solenoid.

* * * * *